United States Patent [19]

Schulz

[11] 4,123,210

[45] Oct. 31, 1978

[54] BRIQUETTE FORMING APPARATUS

[75] Inventor: Albert C. Schulz, Hudson, Ohio

[73] Assignee: Combustion Engineering, Inc., Windsor, Conn.

[21] Appl. No.: 839,063

[22] Filed: Oct. 3, 1977

[51] Int. Cl.[2] ..... B30B 11/02

[52] U.S. Cl. ..... 425/78; 425/352; 425/423

[58] Field of Search ..... 425/78, 256, 352, 354, 425/355, 423, 590, 591, 589; 72/273

[56] References Cited

U.S. PATENT DOCUMENTS

| | | | |
|---|---|---|---|
| 2,252,697 | 8/1941 | Brassert | 72/273 X |
| 2,404,559 | 7/1946 | Ashbaugh | 425/354 X |
| 3,266,096 | 8/1966 | Thomas et al. | 425/256 X |
| 3,736,084 | 5/1973 | Mitchell | 425/78 |
| 3,811,813 | 5/1974 | Taccone | 425/352 X |
| 3,923,440 | 12/1975 | Bettonica | 425/352 X |

*Primary Examiner*—J. Howard Flint, Jr.
*Attorney, Agent, or Firm*—Wayne H. Lang

[57] ABSTRACT

A briquette forming apparatus for compressing a mass of metallic chips into uniformly dense briquettes. The chips are first heated to reduce their yield strength and to simultaneously remove volatile contaminants therefrom. The hot chips are then transferred to a reciprocating press where the chips are compacted in a flared die between a convex anvil and a reciprocating ram.

6 Claims, 5 Drawing Figures

BRIQUETTE FORMING APPARATUS

BACKGROUND OF THE INVENTION

In the operation of a system for the manufacture of hot briquettes from a mass of metallic chips, a briquette is customarily formed by compressing a mass of discrete chips into the space lying between contra-rotating rolls in which depressed portions have been indexed to hold a quantity of chips therebetween.

In order that a greater density may be imparted to the briquettes so they will have a greater resistance to spalling and breakage, reciprocating presses have been developed for the metallic chips. Briquettes formed in this manner have a greater density, but the density varies widely within each briquette so each briquette is still easily broken apart or subject to spalling, so that the theoretical advantages gained are lost in reality.

It has also been discovered that briquettes that have been formed from heated materials from which all volatile constituents have been removed are especially desirable where further melting is desired. This may be considered only desirable as a smoke abatement measure, but it is considered essential where subsequent induction melting is prescribed. Moreover, any residual heat remaining in the briquettes will comprise an effective form of preheat that is utilized fully when the briquettes are subsequently introduced into a melting furnace.

Accordingly, metallic chips are heated to remove volatile constituents therefrom, and then they are formed in a reciprocating press so they produce a suitably shaped briquette. However, briquettes so formed have a variable density and they are still easily broken apart so that the initial advantages gained are completely lost.

SUMMARY OF THE INVENTION

In accordance with this invention, therefore, there is provided a system for compressing uniformly dense briquettes that resist breakage from a mass of hot metallic chips. The chips are first heated to reduce their yield strength so that they may be more readily pressed into briquettes, and a larger press may also be used to increase the capacity of the briquette forming press. Moreover, heating the chips vaporizes oil and water contamination thereon, and any residual heat carried by the chips comprises an effective form of preheat that may be utilized when the briquettes are introduced into a melting furnace. Furthermore, the briquetting press is formed with an anvil having a predetermined convex configuration where the briquettes molded thereby are imparted a uniformly dense composition that resists spalling and breakage when subjected to unregulated shock.

These and other advantages of the present invention will become more apparent when considered in conjunction with the following drawings in which:

DESCRIPTION OF THE PREFERRED EMBODIMENT

Figure 1:
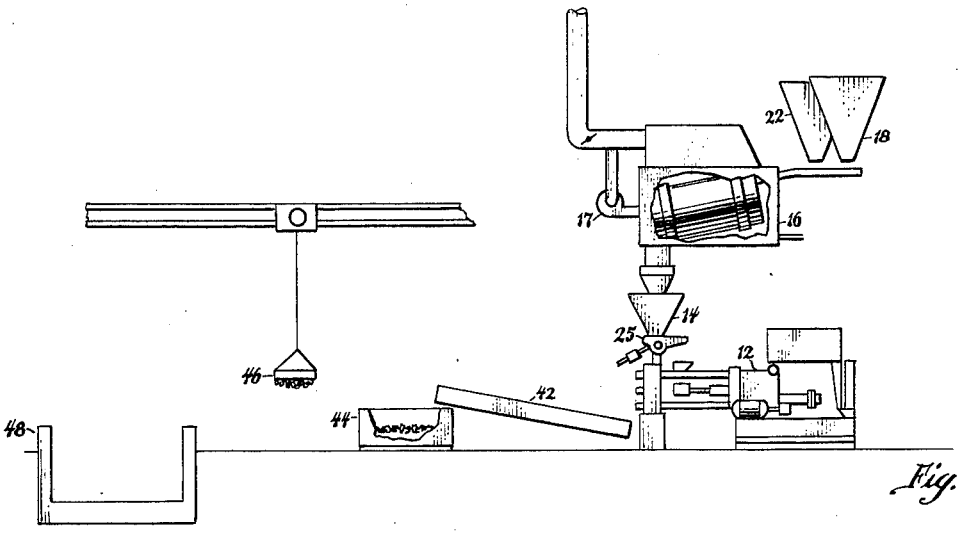
FIG. 1 diagrammatically shows a briquetting system for forming hot chips in a reciprocating press.
Figure 2:
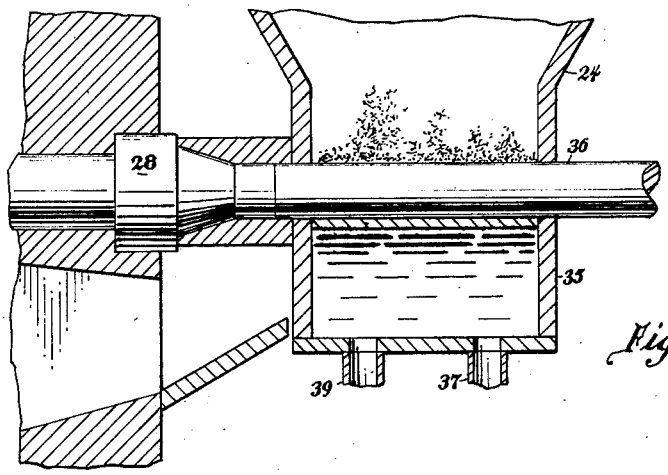
FIG. 2 is a side view, in section, of a briquetting press having a ram compressing a briquette against a cooperating anvil.

Referring more particularly to the drawings wherein the numeral 12 designates a briquette forming machine having a hopper 14 that receives a quantity of hot metallic chips from a heating and drying furnace 16. In furnace 16 oil and water contamination are removed from the chips as a vapor that is generated by heating the chips to a predetermined temperature that ranges from 800° F. to 1400° F. Removal of water and oil contamination increases the compactibility of the chips while the vaporized oil may be directed back through a recirculation fan 17 to the drying furnace to serve as fuel that further heats and dries the chips being supplied to the furnace from the feed hopper 18. A similar hopper 22 in parallel with that at 18 may be used to supply alloying agents or other additives to the drying system before the hot chips are passed to the hopper 14 and measuring device 25 of the briquette forming machine 12.

Figure 3:
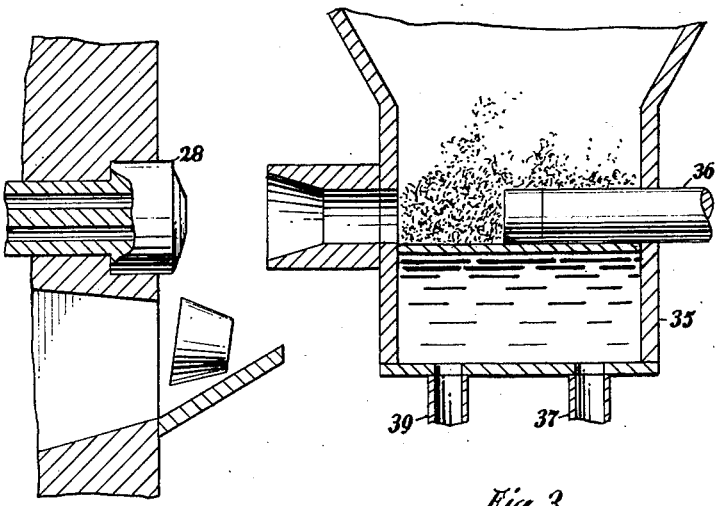
FIG. 3 is a side view, in section, of a briquetting press having a ram withdrawn from its cooperating anvil.
Figure 4:
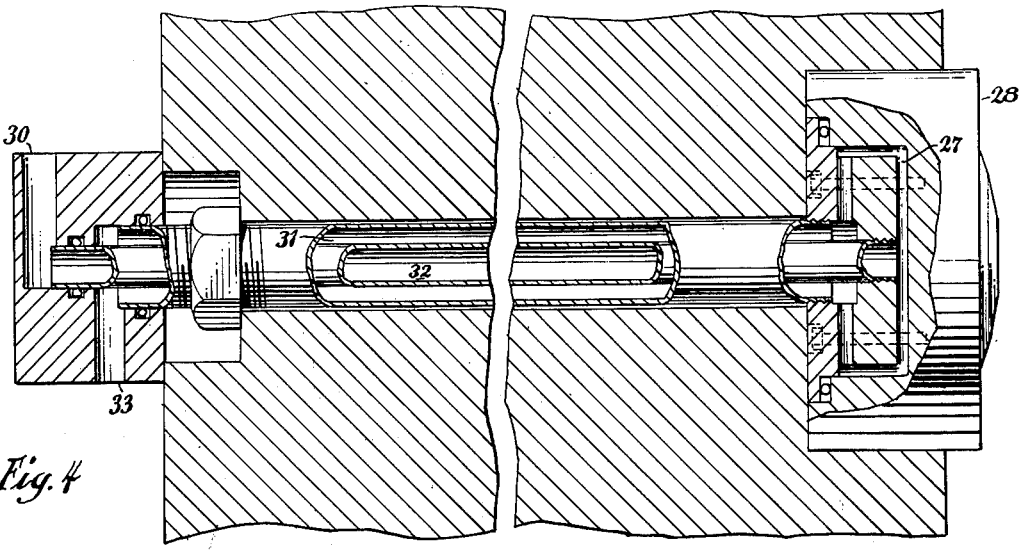
FIG. 4 is an enlarged view that shows the details of a water-cooled anvil of convex configuration.

According to the invention hot chips are then fed to the chip-box 24 that is constantly cooled by a cooling jacket 35 having an inlet 37 and an outlet 39 through which a cooling fluid is continuously circulated. The hot chips are forced by ram 36 into a uniquely shaped die 26 where they are pressed against a convex anvil 28 to form a uniformly dense briquette that resists breakage. The hot chips have a lower yield strength than similar chips do when cold, therefore when compressed into composite blocks the chips interlock so there is much less tendency to "springback" to a normal position occupied by each chip before it was compressed. Furthermore, since the hot chips are free of all forms of oil and water contamination they may be compressed into a briquette of minimum volume. After the briquette has been formed, the chip-box and die assembly, together with the independent ram 36, are withdrawn by conventional means in the manner shown by FIG. 3 causing release of the briquette. The briquette then falls by gravity to a conveyor 42 where it is moved to a storage bin 44, and thence by overhead crane 46 to a melting furnace 48.

Although the briquettes formed in the manner above described are at various times subject to free-fall and other forms of shock, the uniformly high density with which each briquette is made precludes most spalling and breaking that would negate the advantages gained by initially forming the discrete chips into briquettes.

To eliminate overheating of the anvil 28 and to prevent the associated parts of the briquette forming machine from suffering a loss of integrity through long and continuous contact with the hot chips, special passageways for a cooling fluid to flow through the anvil are provided. Accordingly the anvil 28 is cored at 27 to permit a cooling fluid to enter at 30 and flow axially through passageway 31 to cored passageway 27 in anvil 28 and thence to passageway 32 and outlet 35. A cooling jacket 35 having an inlet 37 and and outlet 39 permits the circulation of a cooling fluid therethrough to preclude the temperature of the hopper from rising to that of the heated chips.

Figure 5:
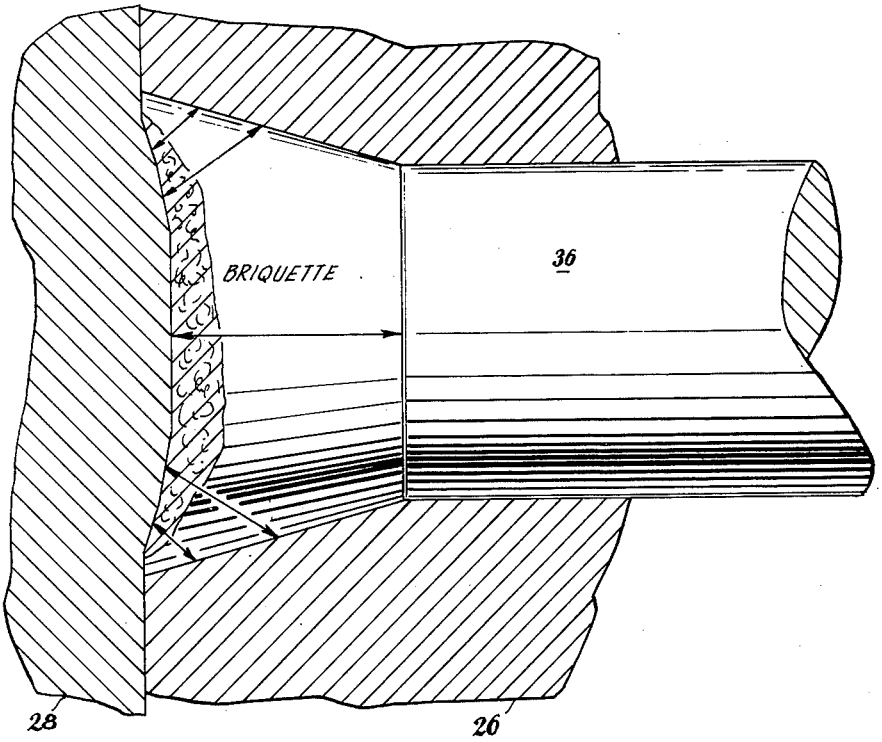
FIG. 5 is an enlarged side view of a briquette in a die between an anvil and a ram that schematically shows the distribution of forces therein.

The uniform high density of each briquette is due partially to the manner of forming each briquette separately from hot chips in a reciprocating press, but most importantly it is due to the unique configuration imparted thereto by the flared die 26 and the slightly convex anvil 28 that together form a cavity mold with a concave end that confronts a reciprocating ram. As the ram 36 compresses the hot chips in die 26 against the convex anvil, a compressive force is reflected angularly outward toward the flared sides of each briquette in the manner shown by FIG. 5 whereby the customarily soft side portions of each briquette are packed to substantially the same uniformly high density as confronting front and rear faces thereof.

The uniformly high density of each briquette imparts thereto resistance to spalling and breakage that results in less melting loss and oxidation when introduced into a melting furnace. Furthermore, the briquettes formed are of a uniform size and density that provides a controlled charge instrumental in enhancing subsequent melting operations.

I claim:

1. Briquette forming apparatus for compressing uniformly dense briquettes from a quantity of hot metallic chips, said apparatus including a chip-box assembly with horizontally aligned apertures adapted to receive said chips, an annular forming die carried by said chip-box in alignment with the horizontally aligned apertures, an anvil with a convex head horizontally aligned with the annular die, means supporting the convex anvil independent from the chip-box assembly, means for moving the chip-box and die assembly horizontally against said convex anvil, and a ram movable through the chip-box and annular die adapted to compress a quantity of metallic chips in said die against the convex anvil.

2. Briquette forming apparatus as defined in claim 1 including a passageway for a cooling fluid extending through said convex anvil.

3. Briquette forming apparatus as defined in claim 1 wherein the walls of the cylindrical die are flared outwardly to form a cavity having a maximum diameter lying adjacent the convex anvil.

4. Briquette forming apparatus as defined in claim 1 wherein the cylindrical die cooperates with the plane end of said ram and the convex anvil to form a cavity for metallic chips having the shape of a truncated cone with a concave base.

5. Briquette forming apparatus as defined in claim 1 wherein the cylindrical die is flared outward adjacent the convex anvil to provide a die having maximum diameter lying adjacent said anvil.

6. Briquette forming apparatus as defined in claim 1 wherein the walls of said die and the convex wall of said anvil meet to form an acute angle adjacent the periphery of the anvil.

* * * * *